United States Patent [19]

Allen

[11] 4,065,997

[45] Jan. 3, 1978

[54] SHOT SHELL RELOADING

[76] Inventor: Johnnie D. Allen, 105 Bayou Vista Drive, Hitchcock, Tex. 77563

[21] Appl. No.: 577,565

[22] Filed: June 16, 1975

Related U.S. Application Data

[63] Continuation-in-part of Ser. No. 411,091, Oct. 30, 1973, abandoned.

[51] Int. Cl.[2] ..... F42B 33/12

[52] U.S. Cl. ..... 86/39; 86/23; 86/31

[58] Field of Search ..... 86/39, 40, 41, 31, 23

[56] References Cited

U.S. PATENT DOCUMENTS 3,240,104 3/1966 Bachhuber ..... 86/39

*Primary Examiner*—Stephen J. Lechert, Jr.

[57] ABSTRACT

A shot shell progressive reloading press particularly including a single step crimping device comprising interiorly protruding equally spaced deflectors of mid-upper diameter of die body and downward protruding cooperating deflectors of abutting surface of elongated finalizing compression plunger, of which is maintained and supported by a heavy spring of which allows restricted reciprocal movement of said plunger of which finalizes crimp of which has been initiated by said protruding deflectors of said die body upon actuation of said reloading press, said crimping device having a capability of initiating and finalizing the crimp of new plastic casings, new paper casings, used plastic casings and used paper casings.

A shot shell reloading press including a tubular resizing die of uniqueness wherein said die comprises upward and outward taper of open and downward end wherein to be received by mating and cooperating slots of receiver index plate, wherein said die is allowed to full length resize said casing, and reform extractor rim of said casing to factory specifications.

A shot shell reloading press including a means of changing from one gauge to another rapidly, wherein a plurality of dies are clustered in a single holder, said holder being retained or released by a single pin of upper platen.

A shot shell reloading press including a quick release receiver index plate, said index plate being retained or released by a single pivot screw.

9 Claims, 9 Drawing Figures

FIG. 1
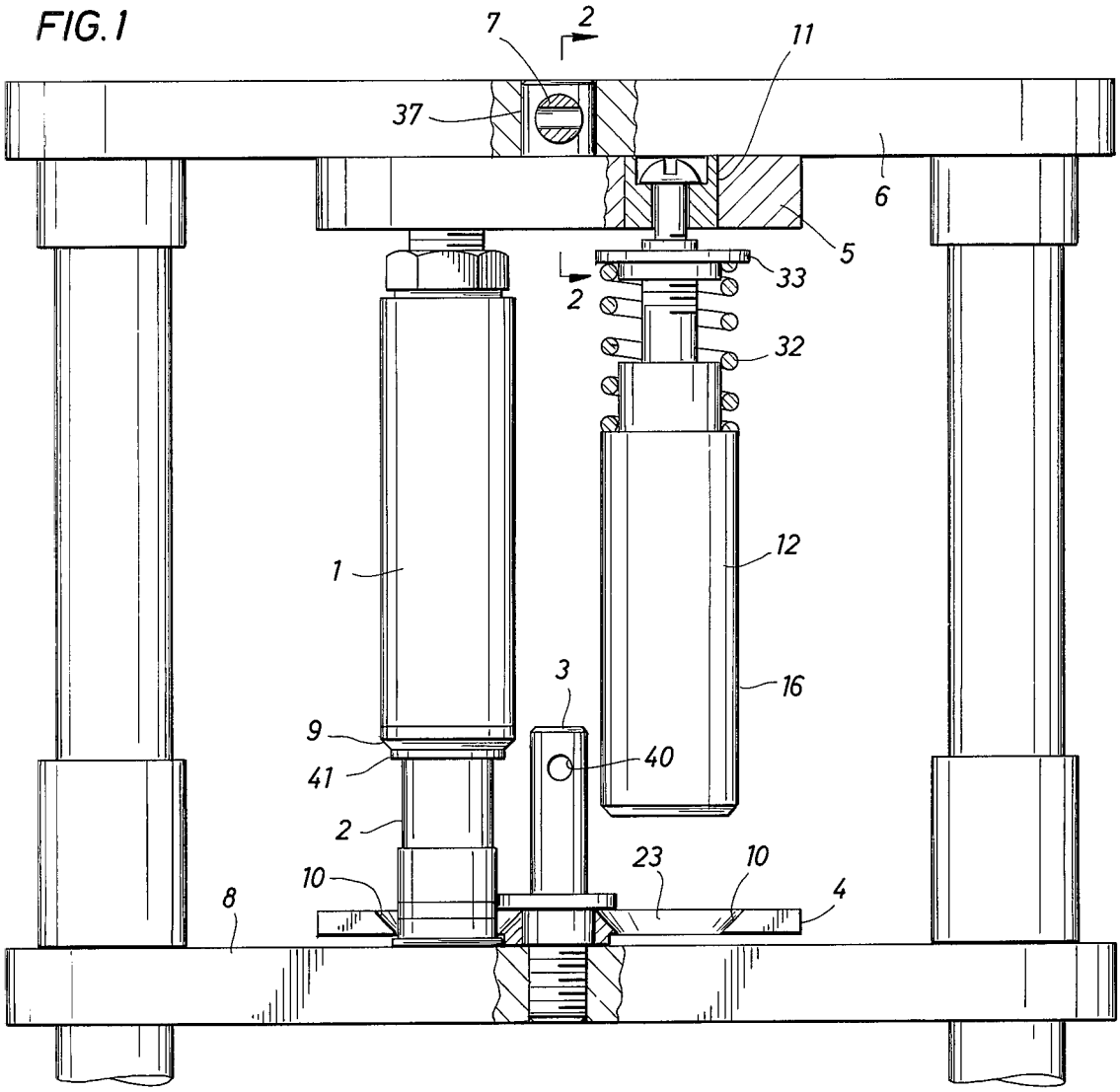
FIG. 2
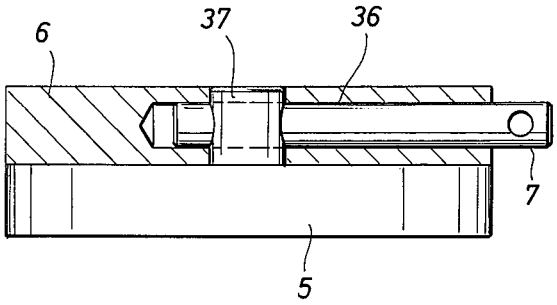
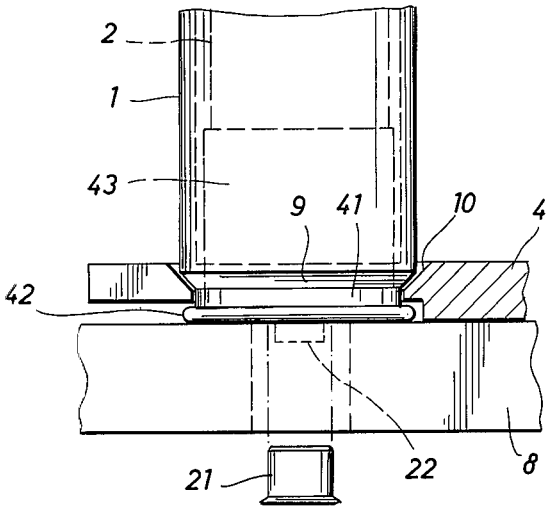
FIG. 3

FIG. 4
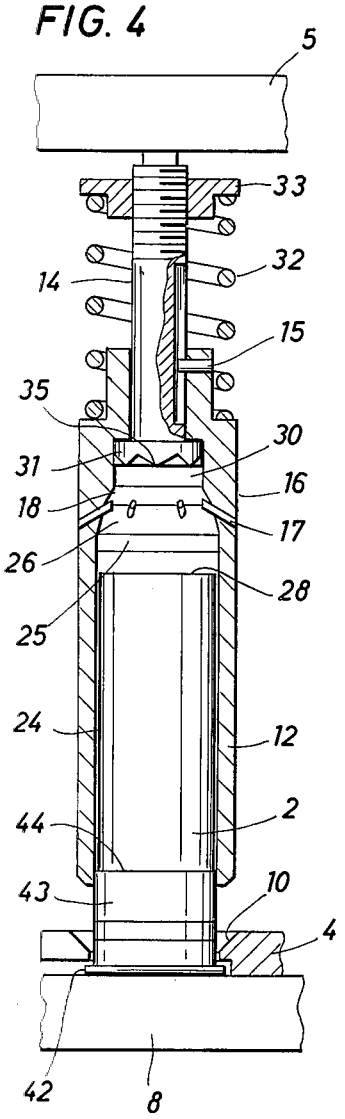
FIG. 5
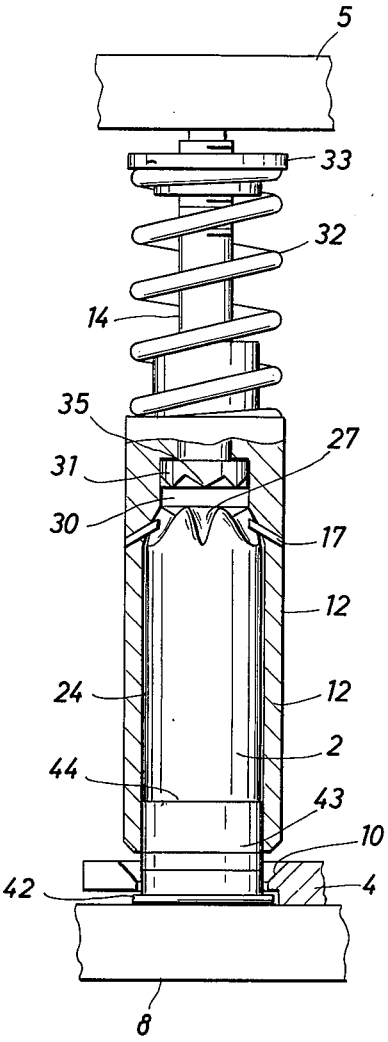
FIG. 6
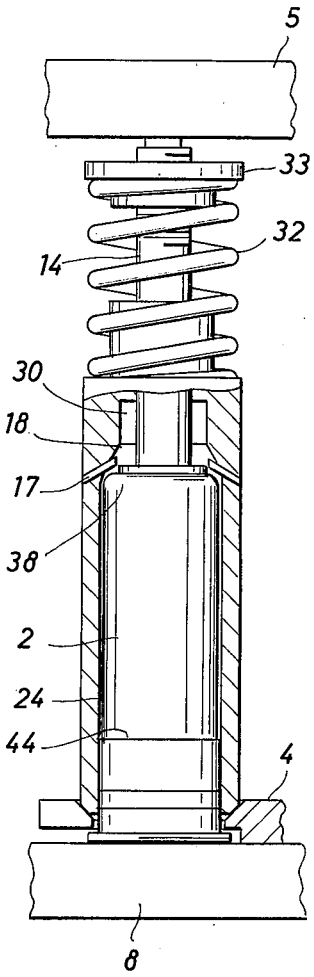
FIG. 7
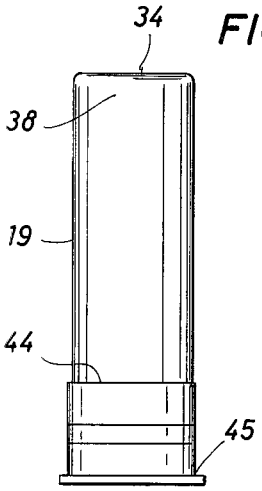
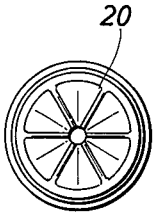
FIG. 8
FIG. 9
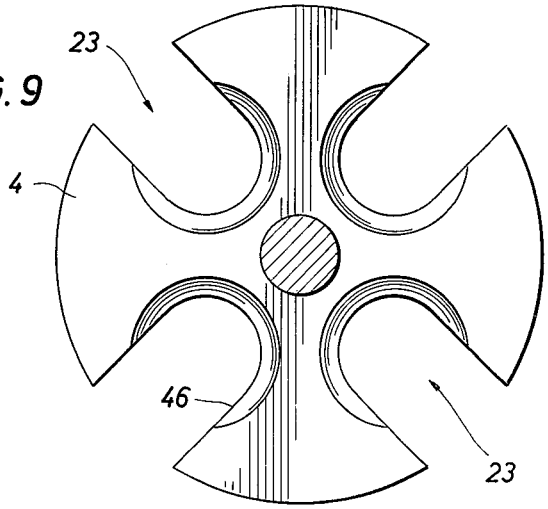

SHOT SHELL RELOADING

This application is a continuation-in-part of application Ser. No. 411,091, filed Oct. 30, 1973, now abandoned.

BACKGROUND OF THE INVENTION

Before plastic was introduced in the manufacture of shot shell casings the then popular paper casings offered no resistence to being crimped as the obvious nature of paper is, that it will fold in its original creases when introduced to any crimping device which comprises a cone or oval shape of its upper interior. However, new paper casings that had never been crimped would not crimp evenly and symetrically without the aid of a separate die that comprised of dividing and creasing deflectors which started the crimp before the casings were introduced to the final crimping die. The starter dies for this operation could be readily furnished by reloading press manufacturers but were not always a common fixture furnished at not extra charge, as most reloaders used only casings that had been previously crimped.

After the introduction of plastic shell casings manufacturers were challenged, wherein that plastic resisted being folded even in its original creases. In citing U.S. Pat. No. 3,055,302, LaVern S. Bayard, Devon and George Eckstein, Fairfield, Conneticut, Assignors of Remington Arms Company, Inc., Bridgeport, Conneticut, I quote of their invention, "the characteristics of the plastic material are quite dissimilar from both paper and metal, i.e., plastic does not take a sharp fold as does paper, being incapable of the slight delamination that takes place in folding paper, it assums puckered shapes unlike those resulting from the crimping of paper or metal." Reloading press manufacturers soon found that the simple starter dies used for new paper casings were not suited for starting the crimp of plastic, either new or used ones. The starter dies were not designed to rotate about the casing until their creasing deflectors picked up the original creases and the creasing deflectors were not precise enough to manulipate the unpredictable plastic.

In the early stages of reloading plastic casings I envisioned a single step crimping device, self contained of creasing deflectors and finalizing crimping facilities. To develop such a device was frustrating and I had my doubts that it could be successful, but I learned something from each new model. After many models and extensive experimenting the device was developed. I found that the many different types of plastic casings available for reloading offered something different in lending itself to be crimped in a single operation. The design of the crimping device to accomplish this is quite complicated and very precise. The dimensions of the crimping area are critical to within 0.002 inches and the angles of the deflectors and deflecting surfaces are critical to within one degree. The Mid-inner area of the die sleeve is also very critical because diameters of casings vary somewhat and the inner area of the die must admit casings freely but not so freely as to allow casings to wrinkle when pressure is applied for crimping. Experiments have taught that it is impossible to achieve a symetrical and even crimp on plastic without the above mentioned deflectors that start the crimp before it is finalized by an elongated plunger.

It was taught that the upper center fixed elongated plunger which finalizes the crimp was not successful when using it in the same fashion as other existing methods, wherein an elongated plunger with a flat abutting surface is used. When using this type of plunger errors were numerous but when I replaced this plunger with one whose abutting surface comprised deflectors cooperating with deflectors of crimping sleeve the errors were reduced drastically. The only problem that remainded was, that the plunger would rotate out of alignment with the deflectors of the crimping sleeve. By equipping the plunger with a keyway which allowed reciprocal movement and the crimping sleeve with a cooperating key this problem was solved.

I was later taught from experiments that the crimping device is so effective on the cold crimping of plastic that it is not essential for the crimping deflectors to align with the former creases in order to get a symetrical and even crimp. Although it is illustrated herein to comprise an uppward mounted swivel that is useful in allowing the crimping device to rotate about the casings in order to seek out the original creases.

The crimp crease deflectors herein illustrated are small pins pressed through the walls of the crimping sleeve. Although this is extremely effective, its production qualitites are poor. I have achieved the same results with totally molded plastic which will be the accepted method of reproduction.

By using several different types of progressive reloading presses, it was found that the ones that attemp to resize the casings do a poor job of it. The receiver index plate having two functions of which include, carrying the casings in a circle to receive their respective operations and extracting casings from their dies after operations have been performed. There is only one manufacturer of progressive reloading presses that full length resizes the casings wherein the' casings are retained within the receiver index plate. It is a very expensive press and very complicated therein to achieve full length resizing. The present invention teaches a unique method of achieving full length resizing and reforming the thin metal extractor rim of the base of the casings by the utilization of a male and a female angle in which allows the resizing die to resize beyond the top surface of the receiver index plate.

The present invention teaches further uniqueness in the transition of one guage to another wherein a progressive reloading press is used. It is emphasized herein that less mechanically inclined are often frustrated by other existing methods. The employment of a single pin to retain and release all upper suspended dies and a single quick action pivot screw being employed to retain and release receiver index plate, being a simple and fast method of achieving transition.

EXPLANATION OF DRAWINGS:

FIG. 1. A partial front elevation of progressive reloading press showing shot shell casing being received by resizer, a front elevation of single step crimper, a section showing swivel mechanism of crimper and a section showing quick action pivot screw of receiver index plate.

FIG. 2. A section showing pin retaining die holder.

FIG. 3. A partial section showing resizer full length resizing a casing, reforming casing extractor rim and ejecting spent primer simultaneously.

FIG. 4. A section showing casing entering crimping sleeve and key and keyway of elongate compression plunger.

FIG. 5. A section showing a casing receiving inital crimp.

FIG. 6. A section showing a casing receiving final crimp.

FIG. 7. A front elevation of loaded and crimped shot shell.

FIG. 8. A top elevation of finished crimp of shot shell.

FIG. 9. A top elevation of receiver index plate.

DETAILED DESCRIPTION OF INVENTION

Because of the obvious nature of progressive shot shell reloading presses the following description herein will be limited of the actual function of said reloading press. Said description will be devoted to innovations of operating dies and other innovations of semi-automatic reloading of shot shells.

It is obvious that the first operations performed on a shot shell casing is the resizing of shot shells casing 2, the ejection of the spent primer 21 and the reforming of the expanded extractor rim 42 of said casing 2. Experience has taught, that in order for a reloaded shot shell to functin properly in repeating shotguns the dimemsions of said casings 2 should be restored to that of new and unfired shot shells. When shot shells are fired, the outward force from the explosion expands the diameter of the metal base and also expands the thickness of the extractor rim 42 of the base of said casings 2. Other existing methods of achieving the resizing operations to said casings 2 wherein a progressive reloading press is utilized is poor, non existent or very expensive. Herein is cited a patent wherein the resizing of said casing 2 is limited. T. J. Bachhuber, "Shotgun Shell Reloader," U.S. Pat. No. 3,240,104, filed Jan. 20, 1964. Item 16, designated as, "notched Rotor," having the same function of present invention designated as, "receiver index plate 4." Inspection will show the sidewalls of casing carrying slots of notched rotor 16 to be vertical which establishes an impossibility to resize said casing beyond the top surface of said notched rotor 16.

The popular Pacific progressive reloading press has combined a resizing die being mounted as an extra tool outside of the receiver index plate wherein the said casings 2 may be resized along with the normal sequence of operation. This is very good but necessitates the reloader to handle the casing twice. The also popular Ponsness reloading press features a successful method wherein said casings 2 are reformed to factory specifications wherein said casings 2 are retained by the receiver index plate. The said Ponsness press employs eight resizing dies wherein said resizing dies are permanently attached to said index plate wherein said casings 2 receive respective operations. The said Ponsness method is very good and also very expensive wherein there is employed eight resizing dies as compared to one of other existing methods. Some manufacturers of said reloading presses do not attempt to resize said casings 2, necessatiting a separate press to resize said casings 2.

The present invention teaches an economical method of uniqueness of which resize said casings 2 to factory specifications wherein there is only one tool employed. FIG. 1 shows a said casing 2 being received by the resizing die 1. It will be noted the male angle 9 of the receiving end of resizing die 1. It will also be noted that the extreme leading end and abutting angle 9 of said die 1, a straight portion 41 of about 0.062 inches in length whose outside diameter is capable of being received inside the said casing slots 23 of receiver index plate 4 wherein the extractor rim 42 of said casing 2 are pressed downward to reform the thickness of said extractor rim 42 to factory specifications as shown in FIG. 3, Items 41 and 42. It will also be noted of FIG. 3 that the employment of male angles 9 and cooperating female angle 10 of said index plane 4 facillitate the short, straight section 41 of resizing die 1. Without the aid of the said male angle 9 of said die 1 and said female angle 10 of said index plate 4 the said section 41 would be necessitated to be of length more than the thickness of said index plate 4, therefore not being well supported as the thickness of the sidewalls of said section 41 are about 0.015 inches. The outside diameter of metal sleeve 43 of said casings 2 and extractor rim 42 of said casings 2 are such that the employment of present invention is allowed wherein there is remained enough area of said extractor rim 42 for said casings 2 to be extracted from said die 1 by the lips 46 of said index plate 4. It is emphasized herein that the present invention of the resizing die 1 is capable of three functions simultaneously. No. 1. Said casings 2 are full length resized to factory specifications. No. 2. The extractor rims 42 of said casings 2 are reformed to factory specifications. No. 3. Spent primers 21 are ejected from said casings 2 by center fixed punch 22. It is also emphasized herein the said functions of present invention are achieved with the actuation of said reloading press. Note: It would be highly impractical to employ a resizing die 1 without a slight internal radius to the lips (not shown) of said die sleeve 47 in order to guide the said casing 2 into said die sleeve 47 and to guide said die sleeve over the top edges 44 of the metal base 43. It is pointed out herein that the said slight radius of present invention is of dimenstions of which perfectly blend into the radius 45 of the said extractor rim 42 thereof.

The second operation obviously performed on said casing 2 of said reloading press is the installation of a new primer (not shown) and the introduction of propellent. The applicant does not claim innovations herein.

The third operation obviously performed on said casing 2 of said reloading press is the insertion of wads and the introduction of shot. The applicant does not claim innovations herein.

The fourth operation obviously performed of said reloading press is the crimping operation of said casing 2 wherein the present invention teaches a method of uniqueness wherein the said casings 2 receive the completed crimp to lips 28 of said casing 2 in a single step wherein said casings 2 are of material and state of material as of which include new plastic, new paper, used plastic and used paper. Herein is cited another patent of a single step operation. T. J. Bachhuber, Shotgun Shell Reloader, U.S. Pat. No. 3,243,790, filed Jan. 24, 1963, Col. 1, lines 27, 28 and 29. "The crimping which follows in the next operation is performed in a single step, this also being a novel feature, as is the ejection of the completed shell." Mr. Bachhuber does not designate a material being used for the one step crimping operation. In 1963 paper was the dominating material being used in the manufacture of shot shells as is obvious to reloaders ordinarily skilled in the art. He also makes reference to shell case 94 to be, "recrimped," and makes use of the words, "previously crimped," in reference to crimping device 150, col. 4, lines 59 – 68. He also does not designate a method of starting the crimping folds of casing 94. It has been established that new paper casings and plastic casings, whether new or used, are crimped only after folding creases have been initiated to the said lips 28 of said casings 2 by a means of creasing deflectors 17 as would be obvious to anyone ordinarily skilled in the art. It is also obvious to anyone ordinarily skilled in the art that the method of said Mr. Bachhuber of said patent is effective only on used paper casings. Also, cited herein another patent of T. J. Bachuber, Shotgun Shell Reloader U.S. Pat. No. 3,240,104, filed Jan. 20, 1964, Col. 1, line 67, item 18, designated by Mr. Bachhuber as creasing die. This die obviously starts the creases to the lips of said casings preceeding crimping tool 20. The method therein described, as would be obvious to anyone ordinarily skilled in the art is a two step crimping method.

The applicants invention herein described is novel and ornamental wherein the said casings 2 to be crimped, receive a completed crimp in a single step, whether it be, new plastic, new paper, used plastic or used paper. Upon starting the actuation of said reloading press casings 2 are freely admitted to crimping sleeve 16 bore 24 of said crimper 12, as the actuation continues, the lips 28 of said casing 2 are forced through a one-eighth inch length section 25 of said bore 24 that is 0.025 inches smaller than the established outside diameter of said casing. The importance of said section 25 of said bore 24 is realized when said crimp to said lips 28 of casings 2 are finalized, wherein said section 25 aids to contain and to size said crimp of the elastic like plastic material. Further actuation of said reloading press, lips 28 of casing 2 are forced into a slightly tapered section having a 10 degree angle from vertical axis and having a length of 3/16 inches as indicated in FIG. 4, item 26. The said section 26 starts a moderate deflection of said lips 28 of casing 2 and, as of section 25 also aids in the sizing of final crimp simultaneously with final crimping operation. Further actuation of said reloading press, said lips 28 are forced into contact and through primary crimping deflectors 17 of which initates creases 27 to said lips. Said deflectors 17 are evenly spaced small crimping redges of precise design of which whose inside diameter allows to admit head 31 of elongate compression plunger by no more than 0.005 inches clearance. Further actuation of said reloading press, lips 28 are forced further through said deflectors 17 wherein said lips 28 are forced into contact with another section 18 of said bore 24 of said crimping sleeve 12 of which comprises a 30 degree angle from horizontal plane wherein the initiated crimp is deflected to center axis. Further actuation of said reloading press forces lips into another smaller area 30, a section of bore retaining said plunger head 31, of elongate compression plunger. Further actuation of said reloading press, said sleeve 16 is forced into abutting contact with receiver index plate 4 wherein the resistence of spring 32 wherein retained between sleeve 16 and adjusting collar 33 of said plunger 14 is exceeded by the force from actuation of said reloading press wherein said plunger 14 starts a forceful decent wherein said crimp is finally crimped by the said plunger 14 compressing the center portion of said crimp beyond top 34 of shot shell. It is emphasized herein that the said compression plunger 14 comprises an abutting face 35 of crimping and deflecting ridges 35 wherein cooperate and mate with said deflectors 17 of said crimping sleeve 16, wherein plunger 14 is also keyed against rotation FIG. 4, item 13 and item 15.

MORE IMPORTANT NOTES OF DESCRIPTION

FIG. 6, item 38 shows the top portion of the shot shell being sized simultaneously with the final crimping operation by the smaller section 25 and the 10 degree section 26. Because of the elastic qualities of the plastic material the shot shell returns to a more normal size after being extracted from crimping device 12 as shown in FIG. 7, item 38.

The effect the crimping die 12 has on plastic casings cannot be over emphasized. Since the manufacturers of shot shells employ both six and eight folds in factory crimping, it is of natural consequence that the recrimping die correspond to the number of folds as originally used. However, the success of the applicants invention does not constitute this. The applicant has used crimping dies with seven creasing deflectors which does not correspond with six or eight and still a good symetrical crimp was realized. It is not intended by the applicant to patent a crimping die with seven deflectors as this would be unpopular with reloaders. There is still the argument among reloaders that a casing should re recrimped in the same existing creases as was used by the factory and for this reason a swivel mechanism is shown as indicated in FIG. 1, item 11. Since swivels of this nature are obvious matter, there will be no further detail in regards to its use.

The nature of other existing progressive reloading presses are sometimes complex and frustrating to make the transition from one gauge shell to another. The present invention is related to a fast and simple method to be more compatable with the less mechanically inclined. Unlike other said reloading presses, wherein the dies are fixed singularly, directly to the upper platen 6 which constitutes a readjustment of said dies after each transition. FIG. 1, item 5 shows a round plate of sufficient thickness to retain and secure respective dies, said plate 5 being fixed below and centrally to upper platen 6 by means of a single pin 7, FIGS. 1 and 2, said pin 7 is pushed or pulled through platen 6 and shank portion 37 of plate 5 to retain or release said plate 5. The hole 36 being a receiver of pin 7 is precisly drilled and reamed to facillitate removal and re-installation and to align dies in their respective order of which cooperate with slots 23 of said index plate 4, said pin 7 being the single retainer of die plate 5. The novel feature herein is realized by the speed and simplicity of which the reloader can make the transition of dies from one gauge to another.

Another novel feature herein described of which cooperate with the transition of said upper dies is the employment of a single quick action pivot screw FIG. 1, item 3 wherein releases or retains said index plate 4. Said pivot screw 3 comprising a hole 40 to facillitate removal and re-installation. The time required to make the transition of said upper dies and said index plate should take no more than ninety seconds.

OTHER NOTES OF DESCRIPTION

It will pointed out herein that the single step crimping device 12 sleeve embodiment 16 can readily be stamped from sheet metal and is capable of being cast or molded of plastic or metal.

It will also be pointed out that the crimping device 12 can readily be modified to exclude compression spring 32 and replace same with mechanical linkages and cam operated elongated plunger 14 such as or similar to a device described throughout and shown in FIGS. 2, 3, and 4, item 44 of patent of T. J. Bachhuber, U.S. Pat.

No. 3,240,104, Shotgun Shell Reloader, filed Jan. 20, 1964.

I claim:

1. A single step crimping device comprised of a tubular crimping sleeve whose interior of said sleeve is comprised to guide a shot shell casing along sidewalls of said interior of said sleeve for which lips of said casing receive a series of operations of which initiate crimp to said lips of said casing, a said sleeve whose upper interior comprises a section of which reduces the diameter of finalized crimp of said casing, a said sleeve comprising a plurality of evenly spaced primary crimping deflectors of said upper interior of said sleeve for the purpose of initiating creases to said lips of said casing, a said sleeve comprising of the upper interior of said sleeve a 30° angle from horizontal plane of which deflects said initiated crimp to axis, a said sleeve comprised of a short smaller bore of which may encase the head portion of elongated compression plunger, a said sleeve comprised of the upper exterior of said sleeve, a smaller section of which may aid to retain a heavy compression spring of which induces precise resistence to said plunger and said casing upon actuation of reloading press, a said sleeve comprised of design to be self contained of dimensions and formations of which initiate said crimp to said lips of said casing, a said sleeve of which receive for utilization thereof essential parts of which aid to finalize the crimp to said casing whose characteristics of material include, new plastic, new paper, used plastic, and used paper upon actuation of reloading press.

2. A single step crimping device comprised of a tubular crimping sleeve as in claim 1, a said crimping sleeve comprised to guide a shot shell casing through the bore of said sleeve in which said casing receives multiple perfected operations of which are employed of the interior of said sleeve, said multiple operations of which initiate the closure of the open end of said casing, a said sleeve which is comprised to receive and to maintain an upper fixed reciprocally operated elongated compression plunger, a said sleeve of which employs precise design and dimensions of upper interior crimping area of which perfectly compress and size said crimp radially to axis simultaneously with finalizing said crimp, a said sleeve being capable of receiving and aid to employ a compression spring of which induces precise resistence to said casing and said plunger in which to initiate and to finalize said crimp, a said sleeve comprised of design to accept of the smallest bore of said sleeve and parallel to horizontal plane of said sleeve, a minature key of which mates and cooperates with keyway of said plunger, a said sleeve comprised of design to employ a number of exterior and interior parts of which are essential to initiating and finalizing the crimp of said casing, a said sleeve comprised of design to initiate said crimp of said casing and whose sleeve is of character of design will receive and utilize essential parts of which finalize the said crimp of new plastic, new paper, used plastic and used paper casings.

3. A single step crimping device whose tubular crimping sleeve is characterized of design of which said sleeve is capable of and with the aid of self contained primary crimping deflectors initiate creases to said lips of said casings, a said sleeve whose character of design of upper interior will deflect said initiated crimp to center axis of said casing, a said sleeve of characteristics in design of which allows employment of elongated compression plunger whose abutting face of force is pluralized of crimping ridges of which cooperate and mate with said primary crimping deflectors of said sleeve, a said sleeve whose character in design allows to admit a said compression plunger whose pluralized face of mating and cooperating ridges aid to finalize initiated crimp of said casing upon actuation of said reloading press, a said sleeve whose character of design allows usage of heavy compression spring of which employs precise resistence to said casing and said plunger in which to initiate and to finalize said crimp to said lips of said casing, a said crimping sleeve characterized in design of which assembled with mating and cooperating parts thereof is capable of initiating and finalizing the said crimp to said lips of said casing whose characteristics of material and state of material include, new plastic, new paper, used plastic and used paper, upon actuation of said reloading press.

4. A single step crimping device whose tubular crimping sleeve and elongated compression plunger as in clain 1 are of character in design of which will allow a modification in which to exclude heavy said compression spring and to replace same with cam and mechanical linkage.

5. A single step crimping device whose tubular crimping sleeve as in claims 1 is of character of design of which will allow reproduction by the various methods of, mechanical fabrication of parts, mechanical fabrication of a single unit, mechanical stamping of parts, mechanical stamping of a single unit, moulding and casting, of parts and moulding and casting of a single unit.

6. A single step crimping device of tubular design of which employs an elongated compression plunger wherein said plunger is utilized to aid the final crimp to the lips of a shot shell casing, a said plunger whose elongated section therein is capable of accepting for utilization thereof a keyway of which allows reciprocal action and prevents rotation of said plunger when engaged with mating and cooperating minature key of crimping sleeve, a said plunger whose abutting surface is pluralized of evenly spaced crimping ridges of which mate and cooperate with primary crimping deflectors of said crimping sleeve, a said plunger characterized of design to allow an upward mounted spring retaining collar, a said plunger characterized in design to fix said crimping device upwardly to adaptable support means of said reloading press, a said plunger when assembled with mating and cooperating parts of said crimping device will aid the final crimp to said lips of said casing whose characteristics of material and whose state of material include, new plastic, new paper, used plastic and used paper upon actuation of said reloading press.

7. A progressive reloading press characterized of design to utilize a plurality of radially mounted reloading dies of which are vertically suspended from individual retaining plate of which is fixed to upper platen of said reloading press by means of a single pin of which is received through a portion of upper platen of said reloading press and through a smaller section provided thereof said retaining plate, whereby removal of said pin releases said dies simultaneously with said retainer plate, whereby reversing the same action for re-installation of dies for a different gauge shell, wherein transition of dies is achieved.

8. A progressive reloading press characterized of design to comprise a rotating shell carrier plate designated as receiver index plate wherein said index plate is centrally fixed to lower platen, a said index plate herein centrally fixed to lower platen by means of a single quick action pivot screw, a said index plate comprising of design, four slots for carrying shot shell casings to respective operations, a said index plate whose shot shell casing slot sidewalls are tapered uppward and outward, a said index plate whose said slots are capable of receiving down and open end of resizing die through said slots for which said resizing die reforms extractor rim of said casings, a said index plate of which allows resizing die to full length resize said casing thereof upon actuation of said reloading press, a said index plate whose said casing carrying slots are capable of admitting a portion of said resizing die of which said resizing die is allowed to reform to factory specifications the extractor rim of said casings, a said index plate therein is capable of extracting said casing from said resizing die after said resizing die has resized said casing and reformed said extractor rim of said casing.

9. A progressive reloading press comprised of characteristics in design to employ a shot shell casing resizer of tubular design and self contained construction of which ejects spent primer simultaneously with resizing operation, a said resizing die of tubular embodiment of which is uppwardly fixed to upper platen support, said die being a part of a plurality of dies, a said resizing die of which one end is open and downward, said die being capable to admit and precisely resized to factory specifications a said casing, a said resizing die whose downward and open end is comprised of an uppward and outward taper, a said resizing die whose extreme open and downward end is comprised of a short resizing section of which is admitted inside said casing carrying slots of receiver index plate, a said resizer whose short section of said resizer is capable of reforming to factory specifications said extractor rim of said casing.

* * * * *